US010762871B2

(12) United States Patent
Sasaki

(10) Patent No.: US 10,762,871 B2
(45) Date of Patent: Sep. 1, 2020

(54) IMAGE CONTROL METHOD AND IMAGE DISPLAY DEVICE

(71) Applicant: NEC Display Solutions, Ltd., Tokyo (JP)

(72) Inventor: Yu Sasaki, Tokyo (JP)

(73) Assignee: NEC DISPLAY SOLUTIONS, LTD., Tokyo (JP)

( * ) Notice: Subject to any disclaimer, the term of this patent is extended or adjusted under 35 U.S.C. 154(b) by 0 days.

(21) Appl. No.: 16/495,758

(22) PCT Filed: Apr. 13, 2017

(86) PCT No.: PCT/JP2017/015173
§ 371 (c)(1),
(2) Date: Sep. 19, 2019

(87) PCT Pub. No.: WO2018/189868
PCT Pub. Date: Oct. 18, 2018

(65) Prior Publication Data
US 2020/0111443 A1 Apr. 9, 2020

(51) Int. Cl.
*G09G 5/00* (2006.01)
*G09G 5/14* (2006.01)

(52) U.S. Cl.
CPC ..... *G09G 5/006* (2013.01); *G09G 5/005* (2013.01); *G09G 5/14* (2013.01); *G09G 2320/08* (2013.01);
(Continued)

(58) Field of Classification Search
CPC ..... G09G 5/006; G09G 5/005; G09G 5/14; G09G 2320/08; G09G 2340/0407; G09G 2340/12
See application file for complete search history.

(56) References Cited

U.S. PATENT DOCUMENTS

2006/0127041 A1* 6/2006 Shimizu ..... G11B 27/3081 386/244
2006/0214927 A1* 9/2006 Ikeda ..... G09G 5/006 345/204
(Continued)

FOREIGN PATENT DOCUMENTS

JP H08-251497 A 9/1996
JP 2002-041010 A 2/2002
(Continued)

OTHER PUBLICATIONS

International Search Report (ISR) (PCT Form PCT/ISA/210), in PCT/JP2017/015173, dated Jul. 18, 2017.
(Continued)

*Primary Examiner* — Michael E Teitelbaum
(74) *Attorney, Agent, or Firm* — McGinn I.P. Law Group, PLLC.

(57) ABSTRACT

An image display method includes: obtaining a composite image that was displayed immediately prior to when a video signal is lost, the composite image being an image in which a first image of an on-screen display (OSD) menu is combined with a display image that is based on the video signal before lost; after the video signal is lost, combining a second image of the OSD menu with the composite image to obtain a combined composite image; and displaying the combined composite image.

7 Claims, 3 Drawing Sheets

(52) U.S. Cl.
CPC . *G09G 2340/0407* (2013.01); *G09G 2340/12* (2013.01)

(56) References Cited

U.S. PATENT DOCUMENTS

| | | | | |
|---|---|---|---|---|
| 2006/0215059 | A1 | 9/2006 | Chang | |
| 2013/0080663 | A1* | 3/2013 | Rabii ..... | G09G 5/006 710/16 |

FOREIGN PATENT DOCUMENTS

| | | | |
|---|---|---|---|
| JP | 2009-020316 | A | 1/2009 |
| JP | 2012-047842 | A | 3/2012 |
| JP | 2012-226222 | A | 11/2012 |

OTHER PUBLICATIONS

Japanese Office Action, dated Jun. 16, 2020, in Japanese Application No. 2019-512132 and English Translation thereof.

* cited by examiner

IMAGE CONTROL METHOD AND IMAGE DISPLAY DEVICE

TECHNICAL FIELD

The present invention relates to an image display method and an image display device for displaying an image such as a display, a projector or the like.

BACKGROUND ART

When an image display apparatus displays on a display screen a video signal input from another device, the user viewing the display screen performs settings and adjustments to the display image such as the color of the display image displayed on the display screen, the position of the display image in the horizontal and vertical directions, contrast, brightness and the like in accordance with an OSD (On Screen Display) menu.

The OSD menu is displayed as an image superimposed on a predetermined area in the display image based on an input video signal. The user performs the aforementioned settings and adjustments to the display image by operating the image of the OSD menu in the display image with a button or knob or a touch panel or the like of the image display device main body.

When displaying an image of the OSD menu, the image display device performs a process of superimposing, that is, combining, the image of the OSD menu on a display image based on an input video signal for display as a composite image on the display screen.

Here, the resolution during display of the composite image in which the image of the OSD menu is combined is also determined based on the respective frequencies of the vertical synchronization signal and the horizontal synchronization signal of the display image based on the video signal. The frequency of each of the vertical synchronization signal and the horizontal synchronization signal is detected from the video signal supplied to the image display device.

For this reason, when the video signal is no longer supplied due to a sudden loss of the video signal supply source or the like, the respective frequencies of the vertical synchronization signal and the horizontal synchronization signal for displaying the display image based on the video signal cannot be obtained. Thereby, the image display device cannot determine the resolution of the display image based on the video signal, cannot generate the display image to be displayed on the display screen, and can no longer continue the process of displaying on the display screen the composite image in which the OSD menu is superimposed.

Therefore, even when the user is displaying the image of the OSD menu and setting and adjusting the display image of the display screen, when the supply of the video signal is lost, the image display device can no longer display the composite image, and so the display screen darkens to an all-black state. As a result, the OSD menu is not displayed either, and the usability in setting and adjusting the display image of the display screen is impaired.

In addition, when the respective frequencies of the vertical synchronization signal and the horizontal synchronization signal cannot be detected from the image of the image signal during startup of the image display device or when the format of the image signal has changed, since the display image cannot be normally displayed the image of the OSD menu is also not displayed.

In order to deal with a video signal in which the respective frequencies of the vertical synchronization signal and the horizontal synchronization signal described above cannot be detected, there is disclosed an image display device that requests a video signal for adjustment from the supply source of the video signal, detects the respective frequencies of the vertical synchronization signal and the horizontal synchronization signal from the video signal for adjustment, and displays the display image (see, for example, Patent Document 1).

PRIOR ART DOCUMENTS

Patent Documents

[Patent Document 1] Japanese Unexamined Patent Application, First Publication No. 2002-41010

SUMMARY OF THE INVENTION

Problem to be Solved by the Invention

However, the display device of Patent Document 1, by dealing with the case where the video signal supply source is not lost, cannot cope with the case in which the video signal is no longer supplied.

Therefore, the image of the OSD menu is not displayed during startup of the image display device and when the format of the video signal has changed. The problem of usability in the setting and adjustment of the display image in the display screen being impaired is thus not solved.

In view of the above-described problems, an object of the present invention is to provide an image display method and an image display device that, during setting and adjusting of a display image in a display screen by the OSD menu, displays the OSD menu on the display screen until the completion of the setting and adjustment in the OSD menu even if the video signal is no longer supplied.

Means for Solving the Problem

The present invention is an image display method for combining an image of an on-screen display (OSD) menu with a display image that is based on an input video signal, and displaying a combined composite image, the OSD menu having an OSD function and performing predetermined setting, the method including: when the video signal is not input in a state in which setting in the image of the OSD menu is performed, displaying a composite image obtained by recombining the image of the OSD menu with the composite image displayed immediately prior thereto.

The present invention is an image display device for combining an image of an OSD menu with a display image that is based on an input video signal, and displaying a combined composite image, the OSD menu having an OSD function and performing predetermined setting, the device including: a combining unit that combines the image of the OSD menu with the display image; an image control unit that, when the video signal is not input in a state in which setting in the image of the OSD menu is performed, displays a composite image obtained by recombining the image of the OSD menu with the composite image displayed immediately prior thereto; and an image output unit that displays the composite image.

Effect of the Invention

According to the present invention, even when the video signal is no longer supplied while setting and adjustment of the display image in the display screen are being performed from the OSD menu, since the composite image that is obtained by combining the OSD menu with the display image based on a video signal that was displayed immediately prior to the video signal no longer being supplied continues to be displayed until the end of the setting and adjustment in the OSD menu, it is possible to improve the usability compared to before due to the OSD menu being displayed in the display screen during setting and adjustment of the display image.

EMBODIMENTS FOR CARRYING OUT THE INVENTION

Figure 1:
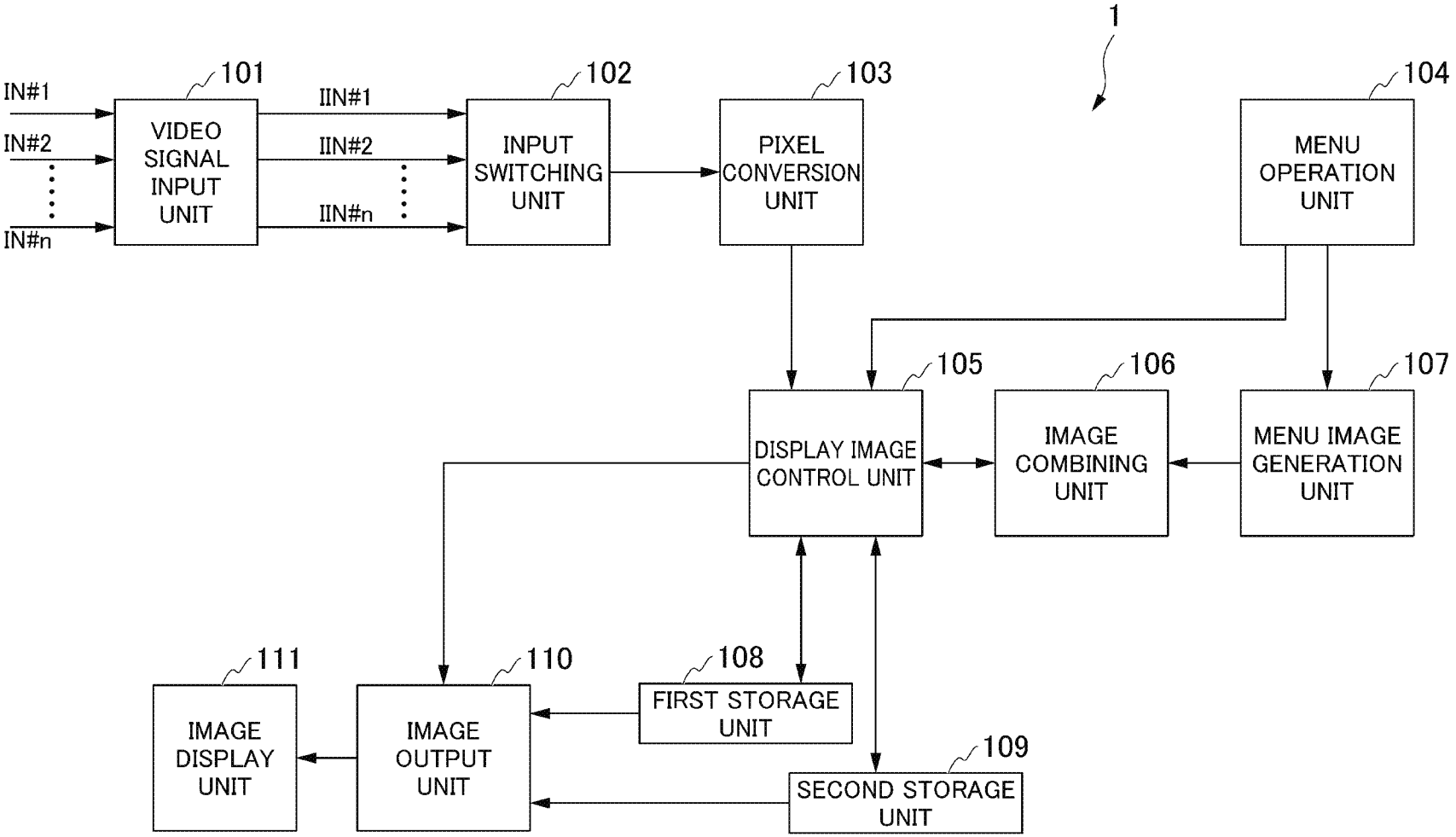
FIG. 1 is a drawing showing a configuration example of the image display device 1 according to an exemplary embodiment of the present invention.

Hereinbelow, an image display device according to an exemplary embodiment of the present invention will be described with reference to the drawings. FIG. 1 is a drawing showing a configuration example of an image display device 1 according to an exemplary embodiment of the present invention.

As shown in FIG. 1, the image display device 1 is provided with a video signal input unit 101, an input switching unit 102, a pixel conversion unit 103, a menu operation unit 104, a display image control unit 105, an image combining unit 106, a menu image generation unit 107, a first storage unit 108, a second storage unit 109, an image output unit 110, and an image display unit 111.

The video signal input unit 101 has a video input interface (input system) that accommodates video signals (IN #1, IN #2, . . . , IN # n) of a plurality of different transmission formats in the digital format and the analog format. When the video signal is in the analog format, the video signal input unit 101 converts the video signal to a video signal in the digital format (IIN #1, IIN #2, . . . , IIN # n) and then outputs the converted signal. Here, examples of digital transmission formats include, for example, DVI (Digital Visual Interface)-D, IEEE 1394, HDMI (registered trademark, High-Definition Multimedia Interface), Ethernet (registered trademark), and SCSI (Small Computer System Interface). Examples of analog transmission formats include S terminal, D terminal, VGA (Video Graphics Array), and DVI-I.

The input switching unit 102 performs switching whether to output any one of the video signals (IIN #1, IIN #2, . . . , IIN # n) supplied from the video signal input unit 101 to the pixel conversion unit 103 in the subsequent stage, in other words, whether to use the video signal as a display image. Here, the input switching unit 102 performs switching of an output terminal in accordance with switching control from a control unit (not shown), and outputs any one of the video signals (IIN #1, IIN #2, . . . , IIN # n) supplied from the video signal input unit 101 to the pixel conversion unit 103.

The pixel conversion unit 103 extracts data of a display image from the video signal supplied from the input switching unit 102 and outputs the data. Also, the pixel conversion unit 103 calculates the resolution and synchronization (horizontal synchronization and vertical synchronization) timing of the display image based on the synchronization signals (horizontal synchronization signal and vertical synchronization signal) included in the video signal, and outputs the data of the display image in accordance with this resolution. Here, the pixel conversion unit 103 outputs the data of the display image, and the calculated resolution and synchronization (horizontal synchronization and vertical synchronization) timing of the display image to the display image control unit 105.

The display image control unit 105 determines whether the video signal is normally input from the input switching unit 102 based on the resolution supplied from the pixel conversion unit 103. Here, the display image control unit 105 determines that the video signal is normally input when the resolution is within the normal value range. On other hand, when the resolution is not within the normal value range, the display image control unit 105 determines that the video signal is normally input.

In addition, when the video signal of the frame to be displayed next on the display screen has been input from the pixel conversion unit 103, the display image control unit 105 causes a composite image that is currently displayed in the display screen and stored in the first storage unit 108 to be written to and stored in the second storage unit 109.

At the point in time at which the display image control unit 105 has detected that a video signal is not input normally, when a predetermined setting process is being performed by the menu operation unit 104, the display image control unit 105 writes to and stores in the first storage unit 108 blank data that makes all pixels black, being of the same resolution as the resolution stored in the first storage unit 108.

The display image control unit 105 compares the data stored in each of the first storage unit 108 and the second storage unit 109. When blank data is not written in the first storage unit 108, the display image control unit 105 determines that a setting process by the OSD menu is being performed and the video signal has not been lost. When a setting process by the OSD menu is being performed and the video signal has not been lost, the display image control unit 105 outputs the data of the input display image to the image combining unit 106, and causes the data of the composite image supplied from the image combining unit 106 to be written to and stored in the first storage unit 108.

On the other hand, when blank data is written in the first storage unit 108 and a composite image is stored in the second storage unit 109, the display image control unit 105 determines that a setting process by the OSD menu is being performed but the video signal is lost. The display image control unit 105 outputs the data of the composite image stored in the second storage unit 109 to the image combining unit 106, and causes the data of the composite image supplied from the image combining unit 106 to be written to and stored in the second storage unit 108.

Further, the display image control unit 105 causes the image combining unit 106 to generate a composite image in synchronization with the synchronization (horizontal synchronization and vertical synchronization) timing calculated by the pixel conversion unit 103.

The image combining unit 106 combines (in the case of a display image) or recombines (in the case of a composite image) the image of the OSD menu supplied from the menu image generation unit 107 with a display image or a predetermined image area of a composite image supplied from the display image control unit 105 and outputs the result as a composite image to the display image control unit 105. At this time, the image combining unit 106 generates a composite image by matching the resolution of the OSD menu image with the resolution of the display image or the composite image supplied from the display image control unit 105.

The menu image generation unit 107 generates an OSD menu screen corresponding to an operation signal for performing a predetermined setting process supplied from the menu operation unit 104 and outputs the result to the image combining unit 106. When an input video signal is displayed on the display screen, this OSD menu is used for performing setting and adjustment to the display image such as the color of the display image displayed on the display screen, the position in the horizontal and vertical directions of the display image, contrast, brightness and the like.

The menu operation unit 104 outputs to the menu image generation unit 107 an operation signal indicating that the OSD menu be displayed by, for example, the user pressing an OSD button for reading the OSD menu. Further, when a predetermined key operation or button operation is performed, the menu operation unit 104 outputs an operation signal corresponding to the key operation or button operation to the menu image generation unit 107. While an operation by the OSD menu is being performed by the user, that is, until the user presses the button for clearing the OSD menu, an operation continuation signal indicating that a process of a predetermined setting by the OSD menu is being performed is output to the display image setting unit 105. Each of the keys and buttons is provided in the main body of the image display device 1 or in a remote controller for operating the image display device 1 or the like.

Each of the first storage unit 108 and the second storage unit 109 is, for example, a VRAM (Video Random Access Memory), being memory for storing image data for displaying an image in the image display device. In the present exemplary embodiment, a display image or a composite image is written and stored therein.

The image output unit 110 outputs to the image display unit 111 one of the data of the display image or composite image stored in the first storage unit 108 and data of the composite image stored in the second storage unit 109 with a control signal from the display image control unit 105.

The image display unit 111 is, for example, a liquid crystal display panel or a liquid crystal panel of a projector.

Figure 2:
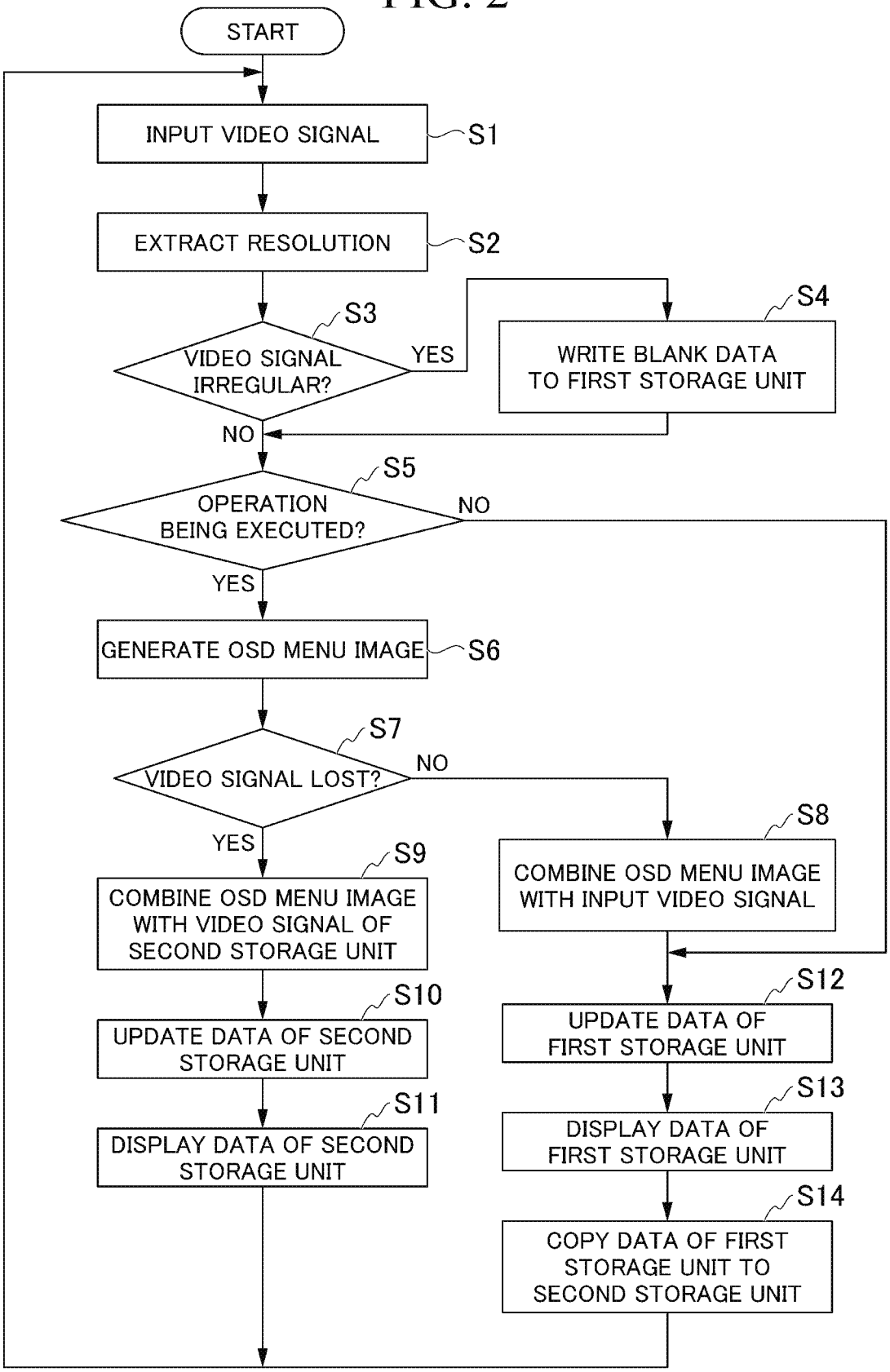
FIG. 2 is a flowchart showing a processing example in which the image display device 1 displays in the display screen a composite image obtained by combining the display image and the image of the OSD menu.

FIG. 2 is a flowchart showing an example of processing in which the image display device 1 displays on the display screen a composite image obtained by combining the display image and the image of the OSD menu.

Step S1:

The video signal input unit 101 outputs each of the video signals (IN #1, IN #2, . . . , IN # n) that have been input to the input switching unit 102 as the video signals (IIN #1, IIN #2, . . . , IIN # n), respectively.

Then, the input switching unit 102 supplies a video signal set by the control unit to the pixel conversion unit 103 from the video signals (IIN #1, IIN #2, . . . , IIN # n).

Step S2:

The pixel conversion unit 103 extracts data of the display image from the supplied video signal, and outputs the data of the extracted display image to the display image control unit 105. Also, the pixel conversion unit 103 extracts synchronization signals (horizontal synchronization signal and vertical synchronization signal) from the video signal, and calculates the synchronization (horizontal synchronization and vertical synchronization) timing on the basis of the synchronization signals. Further, the pixel conversion unit 103 calculates (extracts) the resolution of the display image using each of the horizontal synchronization signal and the vertical synchronization signal.

Step S3:

The display image control unit 105 determines whether the resolution calculated by the pixel conversion unit 103 is within a predetermined numerical range, that is, whether the video signal is irregular. At this time, when the resolution is within the predetermined numerical range, the display image control unit 105 determines that the video signal is not irregular, and advances the process to Step S5. On the other hand, when the resolution is not within the predetermined numerical range, the display image control unit 105 determines that the video signal is irregular, and advances the process to Step S4.

Step S4:

If the display image control unit 105 determines that the video signal is irregular, the display image control unit 105 writes and stores blank data in the first storage unit 108 instead of data of a display image or a composite image.

Step S5:

The display image control unit 105 determines whether an operation continuation signal is supplied from the menu operation unit 104, that is, determines whether a predetermined setting process is being performed using the OSD menu. When the operation continuation signal is being supplied, since a predetermined setting process is being performed using the OSD menu, the display image control unit 105 advances the process to Step S6. On the other hand, when the operation continuation signal is not being supplied, since a predetermined setting process is not being performed using the OSD menu, the display image control unit 105 advances the process to Step S12.

Step S6:

The menu image generation unit 107 generates an image of the OSD menu corresponding to the operation signal supplied from the menu operation unit 104. Then, the menu image generation unit 107 outputs the generated image of the OSD menu to the image combining unit 106.

Step S7:

The display image control unit 105 confirms each set of data of the first storage unit 108 and the second storage unit 109, and determines whether the video signal has been lost. Here, the display image control unit 105 confirms whether the display image (or composite image) of the frame currently displayed and the display image (or composite image) of the frame displayed immediately prior thereto are stored in the first storage unit 108 and the second storage unit 109, respectively.

At this time, when the display image (or composite image) of the frame currently displayed and the display image (or composite image) of the frame displayed immediately prior thereto are stored in the first storage unit 108 and the second storage unit 109, respectively, the display image control unit 105 advances the process to Step S8. On the other hand, when blank data is written in the first storage unit 108 and the display image (or composite image) of the frame displayed immediately prior thereto is stored in the second storage unit 109, the display image control unit 105 advances the process to Step S9.

Step S8:

The display image control unit 105 outputs the data of the display image supplied from the pixel conversion unit 103 to the image combining unit 106 in accordance with the synchronization timing.

The image combining unit 106 combines the display image supplied from the display image control unit 105 and the image of the OSD menu supplied from the menu image generation unit 107, and outputs the combined image as a composite image to the display image control unit 105. Then, after generating the composite image, the display image control unit 105 advances the process to Step S12.

Step S9:

The display image control unit 105, referring to the second storage unit 109, reads the composite image displayed in the immediately preceding frame, and outputs the data of the read-out composite image to the image combining unit 106 in accordance with the synchronization timing.

The image combining unit 106 recombines the image of the OSD menu supplied from the menu image generation unit 107 with the composite image displayed in the immediately preceding frame supplied from the display image control unit 105, and outputs the recombined image as a composite image to the display image control unit 105. Then, after generating the composite image, the display image control unit 105 advances the process to Step S10.

Step S10:

The image combining unit 106 writes to and stores in the second storage unit 109 the data of the recombined image as the composite image, and performs a data update of the second storage unit 109.

Step S11:

The display image control unit 105 outputs a control signal causing the image output unit 110 to display the data of the composite image stored in the second storage unit 109, and advances the process to Step S1.

Thereby, the image output unit 110 reads out data of the composite image from the second storage unit 109 in accordance with the synchronization timing, and outputs the data to the image display unit 111.

Then, the image display unit 111 displays a composite image obtained by recombining the image of the OSD menu with the composite image on the display screen.

Step S12:

The image combining unit 106 combines the video signal supplied from the display image control unit 105 and the image of the OSD menu supplied from the menu image generation unit 107, writes to and stores in the first storage unit 109 the data of the combined composite image, and updates the data in the first storage unit 108.

Step S13:

The display image control unit 105 outputs to the image output unit 110 a control signal causing the display of data of a display image (when a setting by the OSD menu is not performed) or a composite image (when a setting by the OSD menu is performed) stored in the first storage unit 108, and advances the process to Step S14.

Thereby, the image output unit 110 reads data of the display image or composite image from the first storage unit 109 in accordance with the synchronization timing, and outputs the data to the image display unit 111.

The image display unit 111 displays as a predetermined frame on the display screen a composite image obtained by recombining the image of the OSD menu with the display image or the constructed image.

Step S14:

The display image control unit 105 writes to the second storage unit 109 the data of the display image or the composite image stored in the first storage unit 108. That is, the display image control unit 105 copies the data of the first storage unit 108 to the second storage unit 108. Then, display image control unit 105 advances the process to Step S1.

When a video signal is normally supplied by the above-described processing, and the processing of a predetermined setting is not performed by the OSD menu, the display image of the frame displayed in the image display unit 111 is stored in the first storage unit 108. A display image of a frame immediately prior to the frame displayed in the image display unit 111 is stored in the second storage unit 109. Further, when a video signal is normally supplied, and the processing of a predetermined setting is performed by the OSD menu, the composite image of the frame displayed in the image display unit 111 is stored in the first storage unit 108. A composite image of the frame immediately prior to the frame displayed on the image display unit 111 is stored in the second storage unit 109.

In addition, when a video signal is not supplied normally and the processing of a predetermined setting is not performed by the OSD menu, blank data is stored in each of the first storage unit 108 and the second storage unit 109. Further, when a video signal is not normally supplied and the processing of a predetermined setting is performed by the OSD menu, blank data is stored in the first storage unit 108. Further, a composite image of the frame displayed in the image display unit 111 immediately prior to detection of the fact that a video signal is not normally supplied is stored in the second storage unit 109.

With the above-described configuration, according to the present exemplary embodiment, when a video signal is no longer supplied from an external device while a predetermined setting processing by the OSD menu is being performed, since a composite image in the second storage unit 109 is supplied to the image combining unit 106 as a display image combining the image of the OSD menu, and a composite image obtained by recombining the image of the OSD menu according to the resolution of this composite image is displayed in the image display unit 11, it becomes possible to continue a predetermined setting process by the OSD menu. Also, the situation is eliminated in which the setting process by the OSD menu can no longer be performed due to the image of the OSD menu no longer being displayed in the image display unit 111 at the point at which the video signal is no longer supplied, as is conventional, and so the usability of the user setting process can be improved.

Figure 3:
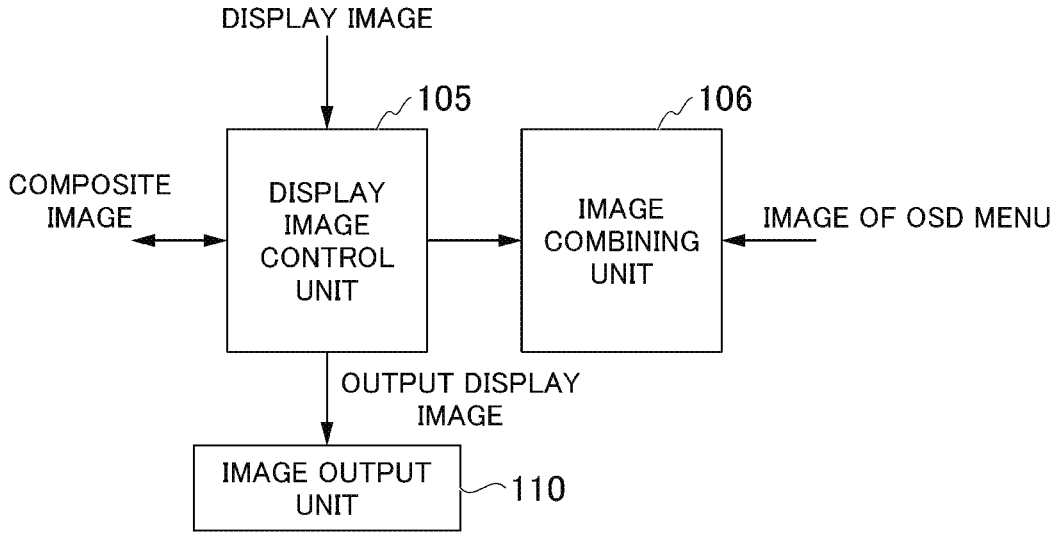
FIG. 3 is a drawing for describing the concept of the exemplary embodiment of the present invention.

FIG. 3 is a drawing for describing the concept of the exemplary embodiment of the present invention. In FIG. 3, the image display device 1 according to the exemplary embodiment of the present invention is an image display device for combining an image of an OSD menu, which has an OSD function and which performs predetermined setting, with a display image based on an input video signal, and displaying a combined composite image, being provided with the display image control unit 105, the image combining unit 106, and the image output unit 110. In the image display device 1, when a predetermined setting processing by the OSD menu is being performed, as an image obtained by the image combining unit 106 combining the image of the OSD menu, the display image control unit 105, when a video signal is normally supplied, outputs the display image extracted from this video signal to the image combining unit 106, and when a video signal is not normally supplied, outputs to the image combining unit 106 a composite image of the frame stored immediately prior thereto.

Thereby, when the video signal is no longer normally supplied while a predetermined setting processing by the OSD menu is being performed, since the image of the OSD menu is recombined with a stored composite image, and the recombination result is output from the image output unit 110, the OSD menu suddenly no longer being displayed in the conventional manner ceases to happen. The user can therefore continue the predetermined setting processing with the image of the OSD menu displayed on the display screen of the image display device, and so the usability for the user is enhanced.

The process of correcting display unevenness in the liquid crystal panel in the image display device of FIG. 1 may be performed by an external computer system for realizing the control function of the image display device. Note that a "computer system" here includes an operating system and hardware such as peripheral devices.

Although exemplary embodiments of the present invention have been described in detail with reference to the drawings, specific constitutions are not limited to the present exemplary embodiments, and designs within a range that does not depart from the gist of the invention are included.

INDUSTRIAL APPLICABILITY

The image display method and the image display device described above can be applied to a device for displaying an image having an OSD function. In particular, the image display method and the image display device are suitable for applications such as a display device and projector device in which a predetermined setting process by an OSD menu is provided as a standard function, as a device whose usability is improved by continuously displaying an image of a menu even if supply of a video signal is lost during setting.

REFERENCE SYMBOLS

1: Image display device
101: Video signal input unit
102: Input switching unit
103: Pixel conversion unit
104: Menu operation unit
105: Display image control unit
106: Image combining unit
107: Menu image generation unit
108: First storage unit
109: Second storage unit
110: Image output unit
111: Image display unit

The invention claimed is:

1. An image display method, comprising:

obtaining a composite image that was displayed immediately prior to when a video signal is lost, the composite image comprising an image in which a first image of an on-screen display (OSD) menu is combined with a display image that is based on the video signal before being lost;

after the video signal is lost, combining a second image of the OSD menu with the composite image to obtain a combined composite image; and displaying the combined composite image.

2. The image display method according to claim 1, further comprising:

storing composite images of frames that were displayed, wherein the combining comprises combining a new image of the OSD menu with the composite image of a latest frame among the stored composite images of the frames.

3. The image display method according to claim 2, wherein the combining the new image is repeated until a setting process using the OSD menu is ended, in a state in which the video signal is lost.

4. The image display method according to claim 1, further comprising:

determining that the video signal is lost when a resolution of the display image based on the video signal cannot be detected from a synchronization signal of the video signal.

5. The image display method according to claim 1, further comprising:

before the image signal is not lost, storing data of a composite image of a first frame to be displayed in a first storage unit and storing, in a second storage unit, data of a display image of a second frame stored in the first storage unit, the second frame being a frame whose display image is displayed before the display image of the first frame is displayed; and after the video signal is lost, storing blank data in which all pixels are black to the first storage unit.

6. The image display method according to claim 5, wherein, when the blank data is stored in the first storage unit, the second image of the OSD menu is combined with the display image of the second frame stored in the second storage unit.

7. An image display device, comprising:

a processor coupled to a memory storing instructions, the processor being configured to:

combine a first image of an on-screen display (OSD) menu with a display image that is based on a video signal before lost to obtain a composite image; and after the video signal is lost, combine a second image of the OSD menu with the composite image to obtain a combined composite image; and an image output unit that displays the combined composite image.

* * * * *